US007409835B2

(12) United States Patent
Briglia et al.

(10) Patent No.: US 7,409,835 B2
(45) Date of Patent: Aug. 12, 2008

(54) BACKUP SYSTEM AND METHOD FOR PRODUCTION OF PRESSURIZED GAS

(75) Inventors: Alain Briglia, Corze (FR); Didier Miniscloux, Paris (FR)

(73) Assignee: Air Liquide Process & Construction, Inc., Houston, TX (US)

( * ) Notice: Subject to any disclaimer, the term of this patent is extended or adjusted under 35 U.S.C. 154(b) by 392 days.

(21) Appl. No.: 11/150,751

(22) Filed: Jun. 10, 2005

(65) Prior Publication Data

US 2006/0010909 A1 Jan. 19, 2006

Related U.S. Application Data

(60) Provisional application No. 60/587,688, filed on Jul. 14, 2004.

(51) Int. Cl.
*F25J 3/00* (2006.01)

(52) U.S. Cl. ..... 62/648; 62/653

(58) Field of Classification Search ..... 62/648, 62/643, 653

See application file for complete search history.

(56) References Cited

U.S. PATENT DOCUMENTS 3,485,053 A * 12/1969 Grenier ..... 62/656
4,698,079 A * 10/1987 Yoshino ..... 62/656
5,865,206 A * 2/1999 Steigman et al. ..... 137/7
5,941,098 A * 8/1999 Guillard et al. ..... 62/656
5,953,937 A * 9/1999 Corduan et al. ..... 62/646
6,889,524 B2 * 5/2005 O'Connor et al. ..... 62/656
6,945,076 B1 * 9/2005 Garnier et al. ..... 62/643
7,092,893 B2 * 8/2006 Megan et al. ..... 705/7
2002/0170313 A1 * 11/2002 Zapp et al. ..... 62/643
2007/0044506 A1 * 3/2007 Peyron ..... 62/617
2007/0101763 A1 * 5/2007 Garnier et al. ..... 62/620

* cited by examiner

*Primary Examiner*—William C Doerrler
(74) *Attorney, Agent, or Firm*—Elwood L. Haynes

(57) ABSTRACT

Systems and methods are disclosed for a gas production system to efficiently maintain a pressure of a gaseous output stream within a tight pressure range when the system changes normal operation to backup operation. In one preferred embodiment, during normal operation a backup vaporizer is kept in cold standby by directing a small portion of a liquefied gas stream away from the main heat exchanger to the backup vaporizer. In this way, the backup vaporizer is able to respond immediately to a shutdown of the main gas production system. During normal operation, the output of the backup vaporizer is recombined with the gaseous output stream to any avoid loss of product thereby increasing efficiency.

21 Claims, 2 Drawing Sheets

BACKUP SYSTEM AND METHOD FOR PRODUCTION OF PRESSURIZED GAS

This application claims the benefit of U.S. Provisional Application No. 60/587,688, filed Jul. 14, 2004, the entire contents of which are incorporated herein by reference.

FIELD OF INVENTION

The present invention provides a process for production of pressurized gas and, more specifically, provides a fast response, cost-efficient backup system for producing pressurized gas.

BACKGROUND OF THE INVENTION

Industrial gas consumers frequently request a relatively tight control in pressure variations of pressurized gas produced from a gas production facility. It is desirable that pressure variations remain within these relatively tight limits regardless of disruptive events that inevitably occur at the industrial facility, at least upon occasion. For example, such events may include stopping operation of the air separation unit for scheduled as well as non-scheduled plant shutdowns.

Similarly, it is also optimal to other users of pressurized gas to minimize pressure variations and to maintain the pressures in a desired range.

In modern air separation units, internal compression processes may be utilized to directly obtain gases under pressure at the cold box outlet. The liquefied gas is extracted from a distillation column, a separator, or a vessel. The liquefied gas may then be compressed by a pump and vaporized under pressure to produce high-pressure gaseous product, e.g., high-pressure gaseous oxygen.

When the normal production of gaseous products stops for any cause such as, for instance, purity upset, scheduled or non-scheduled shutdowns, or other reasons, the delivery of the gaseous products may be maintained by a backup system that may include one or more liquid storage tanks, pumps, and a backup vaporizer of various types. The switch over from normal mode to the backup mode has, in the prior art, generally produced a pressure fluctuation of the gaseous product in the pipeline connecting the air separation unit to the consumers.

To satisfy the customer requests regarding pressure fluctuations, mainly during air separation unit upset or shutdown, several possible solutions have been proposed. Each solution has advantages, but also has significant disadvantages.

One solution would provide a high-pressure gaseous buffer tank installed down stream of the back-up vaporizer. This method provides a very fast response time, but is a capital-intensive solution.

Another proposed solution would involve providing a high-pressure liquid tank installed upstream of the backup vaporizer. This solution provides a relatively fast response time, but is also capital intensive and is limited in the range of operating pressure permitted by this solution.

Another proposed solution would involve running a backup vaporization pump at an extremely reduced rate to minimize the start-up time of the backup pump, and the vaporizer. This method has a very fast response time, but it is liquid and energy consuming.

Consequently, improved systems and method are needed to minimize pressure fluctuations that occur during air separation unit upset or shutdown while simultaneously considerably reducing the capital investment required to effect such systems and methods. It would be desirable to have a simpler system, that is low in energy consumption, useable at all operating pressures, and which has a very fast response time. Those of skill in the art will appreciate the present invention that addresses the above and other problems.

BRIEF DESCRIPTION OF THE FIGURES

For a further understanding of the nature and objects of the present invention, reference should be made to the following detailed description, taken in conjunction with the accompanying drawings, in which like elements are given the same or analogous reference numbers and wherein FIG. 1 provides an illustration of a backup system for producing gaseous product in accord with the present invention.

DETAILED DESCRIPTION OF THE PREFERRED EMBODIMENTS

Figure 1:
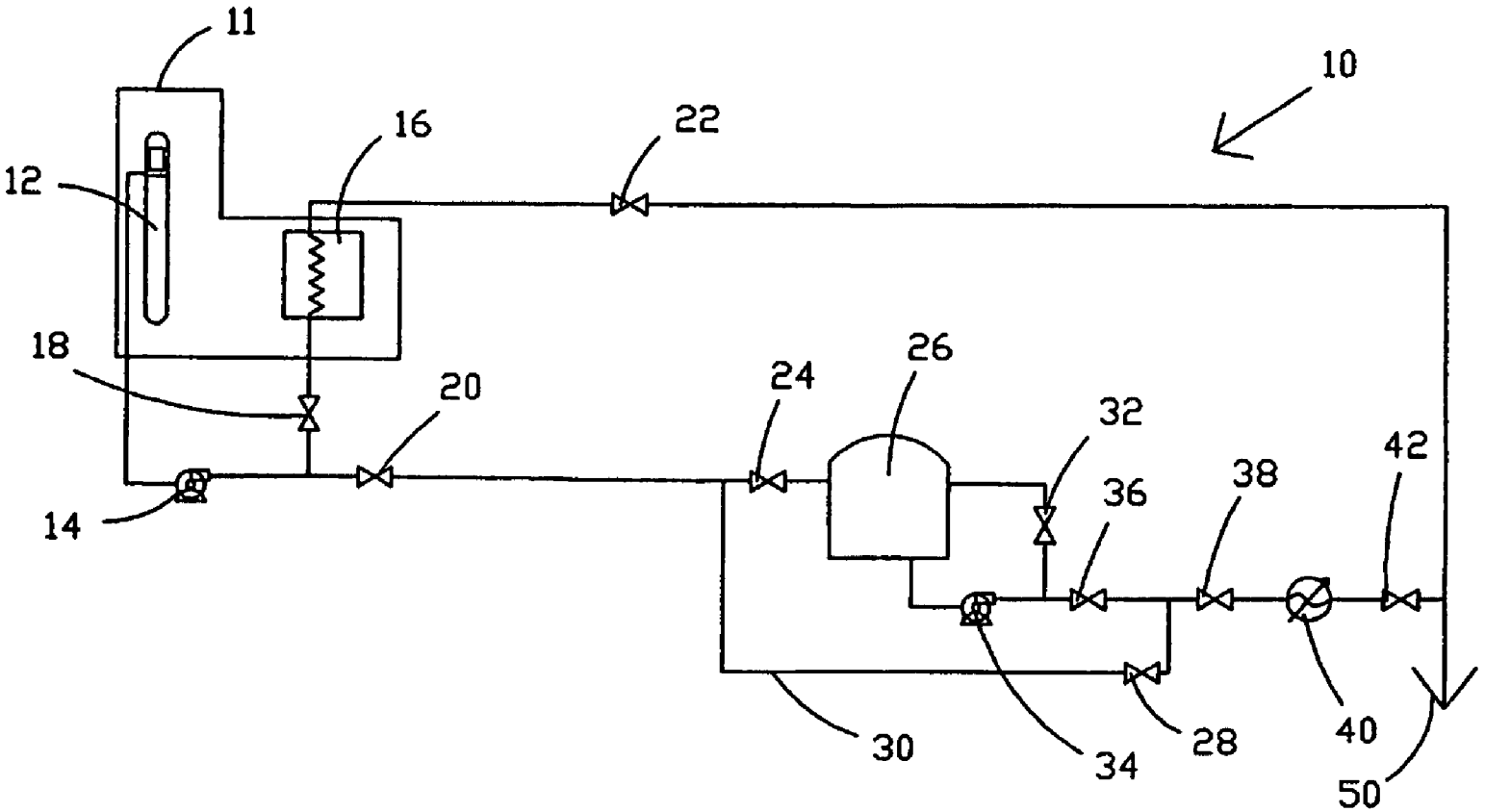
Figure 2:
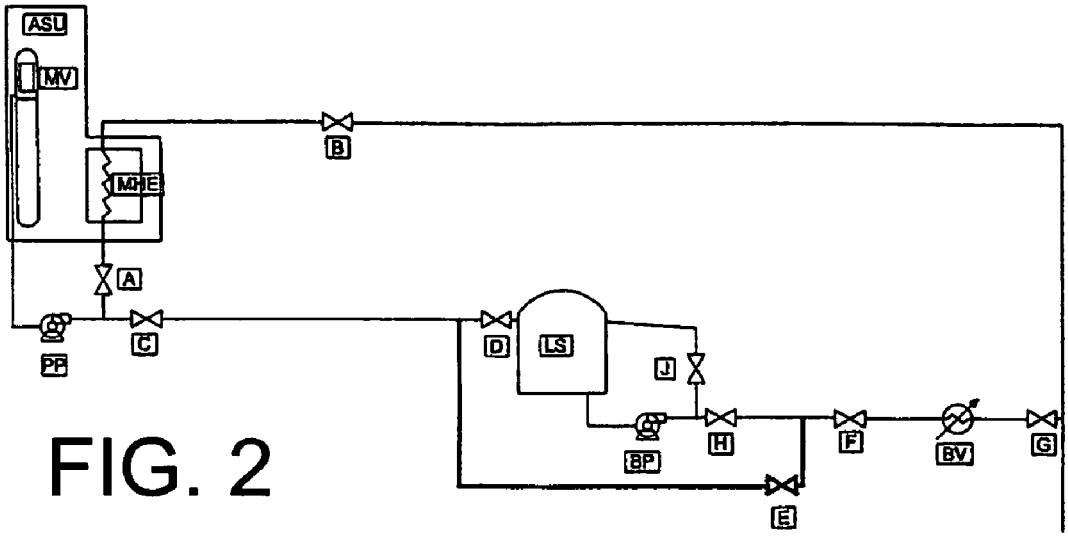
FIGS. 2 and 3 present schematic representations of one embodiment of the present invention.
Figure 3:
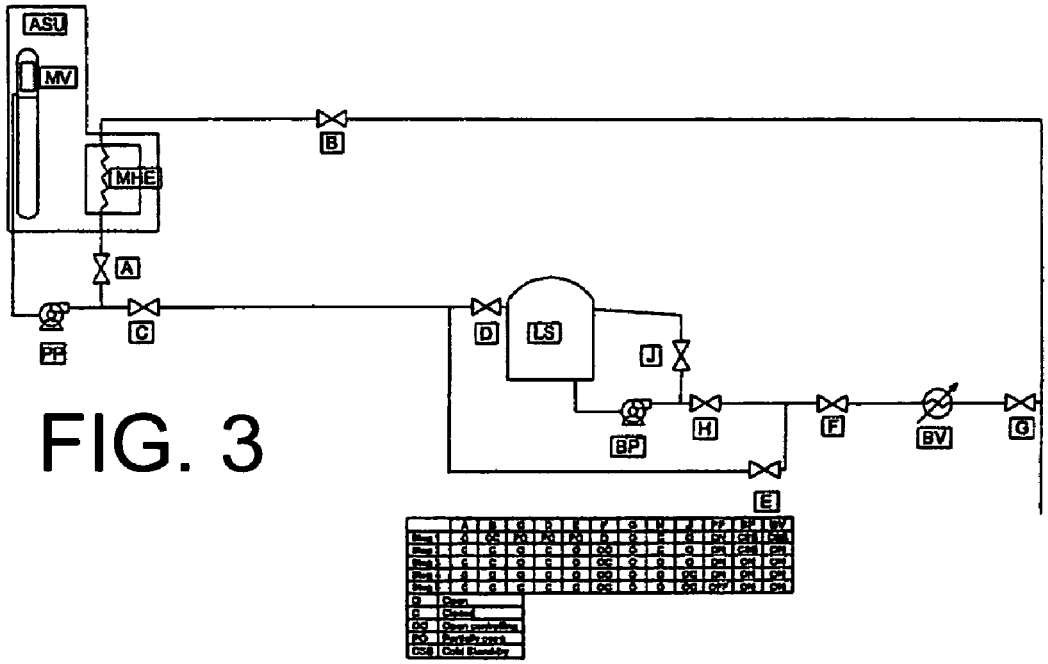

Referring now to FIG. 1, there is shown gas production system 10 which comprises a main and backup gas production system in accord with the present invention.

During normal operation of gas production system 10, liquid such as liquid oxygen and/or other product(s) is separated and extracted in air separation unit 11. Air separation unit 11 may comprise one or more distillation columns 12, heat exchangers, vaporizers, pumps, valves, or other separators, vessels, or components that may normally be utilized for this purpose by one of ordinary skill in the art. The liquid so extracted is then normally compressed by pump 14 and subsequently vaporized under high pressure in main heat exchanger 16.

A backup system for gas production in system 10 is provided downstream of valve 20. Valve 20 controls liquid flow to the backup or transfer flow line. In accord with one embodiment of the present invention, system 10 does not rely for backup only on having backup pump(s) 34 in cold standby but also maintains backup vaporizer 40 in a cold stand-by. Therefore, in accord with a preferred method of the present invention, valve 20 and/or valve 28 of the bypass line 30 may be partially open during normal operation to permit a small portion of the liquid flow therethrough. Valve 38 may also be open during normal operation to thereby maintain backup vaporizer 40 in a cold stand-by.

In this way, a small portion of the produced liquid is diverted from the main flow through valve 18 and main heat exchanger 16 through valve 20. This small portion may typically be less than five percent of the produced liquid and may often be less than or much less than one percent. This extracted liquid which is already compressed at the appropriate pressure by pump 14 is transferred through bypass line 30 to the inlet of backup vaporizer 40 where it is permanently vaporized. The so vaporized gas passes through normally open valve 42 to the produced gas at outlet 50 of the plant and is thereby recombined with the gaseous product coming from main heat exchanger 16 through valve 22. Thus, the diverted liquid is not lost and is therefore efficiently utilized.

The valves used herein may comprise a variety and combinations of valves known to one of ordinary skill in the art including, but not limited to solenoid valves, mechanical valves, which are automatically controlled, manually controlled, or programmable. The valves may further comprise stop valves which shut off or, in some cases, partially shut off the flow of fluids. The involved valves may in addition or alternatively include check valves.

The system may also comprise the use of a regulator or similar apparatus which serve to regulate the flow and pressure (not shown), as well as actuators to open and close the valves.

Except for bypass line 30, the path downstream of valve 20 is the regular transfer line to liquid storage tank 26 which may be used to store sufficient liquid in liquid storage tank 26 for the time the backup system is to be used. The constant and/or controlled flow through the path downstream of valve 20 and through bypass line 30 maintains the transfer line full of liquid, and maintains backup vaporizer 40 in cold stand-by, thereby allowing the backup system to react immediately to any flow to be vaporized.

At the moment air separation unit 11 is tripped, which also causes shut-off of production valve 22 at the outlet of main heat exchanger 16, process product pump 14 is maintained and/or functions in normal pumping operation. All the liquid which is normally compressed and directed through main heat exchanger 16 is then re-routed to backup vaporizer 40 with an appropriate valve sequence, a preferred embodiment thereof is discussed hereinafter. Some of the liquid inventory in distillation column 12 or other vessel is utilized, which may typically be for only a few moments, until backup pumps 34 are started and fully loaded to deliver the product.

It will be noted that for the case of liquid oxygen being vaporized to produce high-pressure gaseous oxygen and/or a cold box architecture sometimes called "side by side" type, the liquid inventory in main vaporizer 16 is not spoiled by the liquid falling from the low pressure distillation column in the case of trip. Thus, the liquid can be used as a clean source of liquid to be vaporized in backup vaporizer 40, again increasing the efficiency of the backup system.

The process of changing from normal to backup operation may be described by a series of steps of operation or change in operation for the various valves, pumps, vaporizers, and so forth. A presently preferred embodiment of this process is subsequently described but it will be understood that many variations thereof are conceivable in accord with the present invention depending of the particular type and construction of the installation, circumstances requiring backup operation, and the like.

For main or normal operation, valves 18, 38, 42, 32 may preferably be open. Valves 20, 24, and 28 may be partially open to keep liquid at the desired pressure within the transfer lines for the backup system, as discussed above. Valve 22 is controlled as desired for maintaining output pressures as necessary and the like. Normally operating process pump 14 is on. Backup pump 34 is in cold standby. Backup vaporizer 40 is in cold standby, as discussed above.

When an event occurs that requires shutting down air separation unit 11, an initial step towards backup operation may involve turning on backup vaporizer 40, and closing valves 18, 22, and 24. Valves 20 and 28 may also be opened at this time. Valve 38 is controlled in a variable open position as necessary for maintaining the desired output pressures and/or other purposes. Process pump 14 remains on and backup pump 34 remains in cold standby during this initial step toward changing from normal to backup operation in this embodiment of operation.

In a subsequent step for changing from normal to backup operation, both process pump 14 and backup pump 34 are temporarily simultaneously on. Valve 36 is opened as backup pump 34 is turned on. In this embodiment, clean liquid inventory from air separation unit 11 may be utilized.

In yet another subsequent step for changing to backup operation, valve 32 may then be controlled for maintaining output product pressure as necessary.

In a final step for changing to backup operation in accord with one method of the invention, pump 14 is turned off after the clean liquid inventor is exhausted and the switch over to backup operation is complete.

Thus, a method is also provided for operating gas production system 10 which comprises a normally operating gas producing system and a backup gas production system. The method provides that changeover from a main or normally operating gas production system to a backup gas production system occurs in a way that minimizes pressure fluctuations and maintains efficient operation. In one embodiment, the method may comprise producing a liquefied gas stream in a normally operating air separation unit 11, pumping the liquefied gas stream with at least one normally operating pump 14 into at least one normally operating heat exchanger 16. Other steps may comprise vaporizing the liquefied gas stream in the normally operating heat exchanger 16 to produce an output product stream. In one embodiment, the method comprises diverting a small portion of the liquefied gas stream, e.g., less than five percent. The method may further comprise directing at least a portion of the diverted liquefied gas stream into backup heat exchanger 40 to maintain backup heat exchanger 40 in a cold standby mode. In a preferred embodiment, the output of backup heat exchanger 40 is combined with the output product stream. The method may further comprise providing that a pressure at an inlet of backup heat exchanger 40 is approximately equal to a pressure at an inlet of main heat exchanger 16 during normal operation to maintain backup heat exchanger and the liquid transfer lines thereto in a cold startup mode for immediate operation and so that gas vaporized in backup heat exchanger 40 is at the desired regulated pressure. The method may further comprise changing from normal operation to backup operation by shutting off flow of the liquefied gas stream to normally operating or main heat exchanger 16, and diverting all of the remaining liquefied gas stream to backup heat exchanger 40. Other steps may comprise at least temporarily continuing to pump all of the liquefied gas stream with at least one normally operating process pump 14. The method may further comprise subsequently turning on at least one backup pump 34. In one embodiment, the method may further comprise providing that normally operating pump 14 and backup pump 34 are temporarily simultaneously on during the changing from normal operation to the backup operation. In one presently preferred embodiment, the method may further comprise storing at least a portion of the diverted liquefied gas stream in liquid storage tank 26. The method may further comprise providing bypass line 30 around liquid storage tank 26 to connect with backup heat exchanger 40.

The present invention may include additional or fewer valves, tanks, pumps, separators, vessels, and flowlines, variations in connections, locations, arrangement, and/or other equipment and interrelated components.

Preferably the process and apparatus also include the use of an apparatus which monitors pressure and/or flow in part or all of the system. Such apparatus are readily known and used by one skilled in the art for similar and related applications (not shown).

Further, the process and apparatus may use dew point monitoring technology to ensure the purity of the product or gases prior to usage (not shown).

The apparatus also preferably has at least one component such as a computer, programmable logic device or other component known or used by one skilled in the art for recording and/or storing data about the pressure, flow, and/or purity of the gas and/or liquid which is analyzed during the process.

The data logging and reporting maybe accomplished by components which are known to one skilled in the art.

The apparatus also preferably has at least one unit for displaying or reporting data. The data may be displayed on a variety of components such as a CRT, LED screen, computer monitor, paper printout and other types of displaying means known or used by one skilled in the art (not shown). The apparatus may also have sound and/or light components and alarms to indicate when certain processes occur, when the desired environment is reached, or when there is a problem or failure with the gas, liquid media, pressure, flow or other parameters measured or monitored by one skilled in the art (not shown).

Preferably the apparatus also has a component for storing the data such as a mainframe computer, hard drive, portable computer unit, or the like known or used by one skilled in the art (not shown).

For the purposes of the description of this invention, any terms to be utilized such as "upper", "lower", "right", "left," "vertical", "horizontal", "top", "bottom", and other related terms shall be defined as to relation of embodiments of the present invention as it is shown and illustrated in the accompanying FIG. 1. Further, for purposes of the description of this invention, the terms "upper portion", "lower portion", "top", "bottom", and the like shall be defined to mean an upper portion and a lower portion and not specific sections. However, it is to be understood that the invention may assume various alternative structures and processes and still be within the scope and meaning of this disclosure. Further, it is to be understood that any specific dimensions and/or physical characteristics related to the embodiments disclosed herein are capable of modification and alteration while still remaining within the scope of the present invention and are, therefore, not intended to be limiting.

Thus, it will be understood that many additional changes in the details, materials, steps, processes, and arrangement of parts, which have been herein described and illustrated in order to explain the nature of the invention, may be made by those skilled in the art within the principle and scope of the invention as expressed in the appended claims. Thus, the present invention is not intended to be limited to the specific embodiments in the examples given above and/or the attached drawings.

We claim:

1. A method for operating a gas production system, said gas production system comprising a normally operating gas production system and a backup gas production system, said method comprising:

producing a liquefied gas stream in a normally operating air separation unit;

pumping said liquefied gas stream with at least one normally operating pump into at least one normally operating heat exchanger;

vaporizing said liquefied gas stream in said normally operating heat exchanger to produce an output product stream;

diverting a small portion of said liquefied gas stream to produce a diverted liquefied gas stream;

directing at least a portion of said diverted liquefied gas stream into a backup heat exchanger to maintain said backup heat exchanger in a cold standby mode; and combining an output of said backup heat exchanger with said output product stream.

2. The method of claim 1 further comprising changing from normal operation to backup operation by shutting off flow of said liquefied gas stream to said normally operating heat exchanger, and diverting remaining of said liquefied gas stream to said backup heat exchanger.

3. The method of claim 2 further comprising at least temporarily continuing to pump all of said liquefied gas stream with said at least one normally operating pump.

4. The method of claim 3 further comprising turning on at least one backup pump.

5. The method of claim 4 further comprising providing that said normally operating pump and said backup pump are temporarily simultaneously on during said changing from normal operation to said backup operation.

6. The method of claim 1 further comprising providing that a pressure at an inlet of said backup heat exchanger is approximately equal to a pressure at an inlet of said main heat exchanger during normal operation.

7. The method of claim 1 further comprising storing at least a portion of said diverted liquefied gas stream in a liquid storage tank.

8. The method of claim 7 further comprising providing a bypass line around said liquid storage tank to connect with said backup heat exchanger.

9. The method of claim 1 further comprising diverting less than five percent of said liquefied gas stream to produce said diverted liquefied gas stream.

10. A system for producing gas, said system having a normal operation mode and backup operation mode, said system comprising:

a normally operating air separation unit;

a normally operating process pump;

a normally operating vaporizer to produce an output stream;

a backup vaporizer;

a backup input flow line between said normally operating process pump and said backup vaporizer;

at least one valve operable for diverting a small portion of liquid from said normally operating vaporizer to said backup vaporizer through said backup flow line during said normal operation mode; and a backup vaporizer output flow line from said backup vaporizer for combining vaporized liquid from said backup vaporizer with said output stream during normal operation.

11. The system of claim 10 further comprising:

a backup liquid storage tank;

a backup pump at an outlet of said backup liquid storage tank; and a bypass flow line around said liquid storage tank to connect said backup input flow line to said backup vaporizer.

12. A method for minimizing pressure fluctuations of a gaseous output stream from a gas production system when changing from normal operation to backup operation, said method comprising:

producing a liquefied gas stream in a normally operating air separation unit;

pumping said liquefied gas stream with at least one normally operating pump to an inlet of at least one normally operating vaporizer;

vaporizing said liquefied gas stream in said normally operating heat exchanger to produce an output product stream;

diverting a portion of said liquefied gas stream to an inlet of backup vaporizer during said normal operation to maintain said backup heat exchanger in a cold standby mode; and providing that a pressure at said inlet of said backup heat exchanger is substantially equal to a pressure at said inlet of said at least one normally operating vaporizer during normal operation.

13. The method of claim 12 further comprising combining an output of said backup heat exchanger with said output product stream during normal operation.

14. The method of claim 12 further comprising shutting off flow to said normally operating vaporizer when changing from said normal operation to said backup operation.

15. The method of claim 12 further comprising at least temporarily continuing to operate said normally operating pump after said step of shutting off flow to said normally operating vaporizer when changing from said normal operation to said backup operation.

16. The method of claim 12 wherein said step of diverting further comprises diverting less than five percent of said liquefied gas stream.

17. The method of claim 12 wherein said step of diverting further comprises filling a liquid storage tank during normal operation with sufficient liquid to maintain said output product stream during said backup operation.

18. The method of claim 17 further comprising providing a bypass line around said liquid storage tank to said backup vaporizer.

19. The method of claim 17 further comprising providing a backup pump for pumping liquid from said liquid storage tank during said backup operation.

20. The method of claim 19 further comprising at least temporarily simultaneously operating said at least one normally operating pump and said backup pump when changing from said normal operation to said backup operation.

21. The method of claim 13 wherein said step of diverting further comprises positioning at least one valve partially open to permit said portion of said liquefied gas stream flow to said inlet of said backup vaporizer during said normal operation.

* * * * *